US008184126B2

(12) United States Patent
Peeters et al.

(10) Patent No.: US 8,184,126 B2
(45) Date of Patent: May 22, 2012

(54) METHOD AND APPARATUS PROCESSING PIXEL SIGNALS FOR DRIVING A DISPLAY AND A DISPLAY USING THE SAME

(75) Inventors: Mathias Hubertus Godefrida Peeters, Eindhoven (NL); Michiel Adriaanszoon Klompenhouwer, Eindhoven (NL)

(73) Assignee: Chimei Innolux Corporation, Miao-Li County (TW)

( * ) Notice: Subject to any disclaimer, the term of this patent is extended or adjusted under 35 U.S.C. 154(b) by 1018 days.

(21) Appl. No.: 12/092,711

(22) PCT Filed: Oct. 30, 2006

(86) PCT No.: PCT/IB2006/054005

§ 371 (c)(1),
(2), (4) Date: May 6, 2008

(87) PCT Pub. No.: WO2007/054852

PCT Pub. Date: May 18, 2007

(65) Prior Publication Data

US 2008/0266318 A1 Oct. 30, 2008

(30) Foreign Application Priority Data

Nov. 9, 2005 (EP) ..... 05110562

(51) Int. Cl.
*G09G 5/00* (2006.01)

(52) U.S. Cl. ..... 345/611; 345/589; 345/606; 345/619; 345/643; 382/260; 382/264; 382/272

(58) Field of Classification Search ..... None
See application file for complete search history.

(56) References Cited

U.S. PATENT DOCUMENTS

| | | | | |
|---|---|---|---|---|
| 6,608,632 | B2 * | 8/2003 | Daly et al. | 345/698 |
| 2005/0083352 | A1 | 4/2005 | Higgins | |
| 2005/0099426 | A1 | 5/2005 | Primerano et al. | |

FOREIGN PATENT DOCUMENTS

| | | | |
|---|---|---|---|
| EP | 0415350 | A2 | 3/1991 |
| EP | 1051042 | A1 | 11/2000 |

(Continued)

OTHER PUBLICATIONS

Lee et al: "40.5L: Late-News Paper: TFT-LCD With RGBW Color System"; 2003 SID International Symposium Digest of Technical Papers, Baltimore, MD, May 20-22, 2003, SID, vol. 34/2, May 20, 2003, pp. 1212-1215.

*Primary Examiner* — Antonio A Caschera
(74) *Attorney, Agent, or Firm* — Thomas|Kayden

(57) ABSTRACT

A method of processing image data comprises receiving input signals for specifying red, green and blue colors of the pixels of a display, performing a per-pixel low pass filtering of the input signals, the low pass filtering function being dependent on the chrominance variation between adjacent pixels, and providing the filtered output signals for use in driving the pixels of a display. This method essentially measures the chrominance variation of the incoming signal, in the form of the color change frequency, and depending on this variation, adaptively low-pass filters the incoming signal. This can be in such a way that the chrominance resolution of the outgoing signal is below the maximum chrominance resolution of the intended display, without errors in the average color of a small group of pixels.

18 Claims, 6 Drawing Sheets

FOREIGN PATENT DOCUMENTS

| | | | |
|---|---|---|---|
| JP | 2000-330522 | | 11/2000 |
| JP | 2002-14667 | | 1/2002 |
| JP | 2004-78215 | | 3/2004 |
| JP | 2004-522371 | | 7/2004 |
| JP | 2005-134540 | | 5/2005 |
| WO | WO03005705 | A1 | 1/2003 |
| WO | WO2004051612 | A2 | 6/2004 |
| WO | WO2005045757 | A2 | 5/2005 |

* cited by examiner

METHOD AND APPARATUS PROCESSING PIXEL SIGNALS FOR DRIVING A DISPLAY AND A DISPLAY USING THE SAME

The present invention relates to methods, apparatus and computer program for driving displays comprising arrays of pixels.

The most common form of pixilated colour display is currently the colour liquid crystal display (LCD). Colour LCDs typically comprise a two-dimensional array of display elements, each element including red (R), green (G) and blue (B) sub-pixels employing associated colour filters. The colour filters of each element absorb approximately ⅔ of the light passing through them. In order to increase optical transmittance, it is known practice in the art to add a white sub-pixel (W) to each element in a manner as depicted in FIG. 1 wherein a three-sub-pixel RGB element is indicated by 10, and a four-sub-pixel RGBW element including a white (W) sub-pixel is indicated by 12.

In the element 12, the red (R), green (G) and blue (B) sub-pixels each have an area which is 75% of that of a corresponding colour-sub-pixel included in the element 10. However, the white (W) sub-pixel of the element 12 does not include a colour filter and in operation is able to transmit an amount of light corresponding approximately to the sum of light transmissions through the red (R), green (G) and blue (B) sub-pixels of the element 12. Thus, the element 12 is capable of transmitting substantially 1.5 times more light than the element 10. Such enhanced transmission is of benefit in LCDs employed to implement television, in lap-top computers where increased display brightness is desired, in projection television (rear and front view, LCD and DLP), in mobile phones/mobile devices where highly energy-efficient back-lit displays are desired to conserve power and thereby prolong useful battery life, and in LCD/DLP graphics projectors (beamers).

As the resolution of mobile displays keeps increasing, the size of the pixels (pixel pitch) decreases. As the electronics in each sub-pixel, such as wiring and the thin film transistor (TFT), do not scale with the size of the pixels, the aperture of the sub-pixels decreases even faster than the size of the sub-pixels. This means that the brightness and thus power consumption of the backlight needs to increase, in order to get enough light out of the display. As both brightness and power consumption are very important for mobile displays, other solutions are required.

The introduction of the white sub-pixel aims to address this problem. However, when the aperture is smaller, the gain of adding a white sub-pixel to each pixel is also smaller, because the additional (white) sub-pixel also needs additional electronics. For very high-resolution displays with a very small pixel-pitch and thus a very small aperture, adding a white sub-pixel to each pixel can even reduce the light output of the display.

A further approach developed by ClairVoyante (Trade Mark) Laboratories uses a smaller number of sub-pixels, and uses appropriate sub-pixel rendering in order to give the same perceived resolution as conventional RGB striped technology. One approach uses only two thirds of the columns, so that there are on average two sub-pixels for each pixel, and this gives a larger pixel aperture than the conventional RGB striped technology.

FIG. 2 shows one system proposed by the applicant for deriving the sub-pixel drive signals for this type of display from a conventional RGB input.

The system starts with gamut mapping or clipping 20. Although an RGBW pixel is able to transmit more light, the output gamut is altered, so there are regions of the RGB colour space which cannot be obtained with the increased brightness. The gamut mapping thus converts the RGB values into values suitable for display with an RGBW pixel.

A multi-primary conversion 22 converts the values into suitable drive values for the RGBW pixel. An optional redistribution function 24 can alter the RGBW values in order to provide different display characteristics, and this redistribution is in response to an external control signal "control".

This is followed by sub-pixel sampling 26 for RGBW displays with the reduced sub-pixel count. This sampling can halve the number of sub-pixels per input pixel whilst maintaining the same perceived resolution.

One sub-pixel sampling method which has been proposed either discards the driving value for white (mapping the RGBW pixel on a RGB sub-pixel triplet), or discards the driving values for red, green, and blue (mapping the RGBW pixel on a white sub-pixel), without filtering.

This does not affect the luminance resolution, which mainly determines the perceived resolution, as both the RGB triplet and the white sub-pixel are used as luminance pixels.

FIG. 3 shows this example of proposed sub-pixel sampling method, and shows the processing for a block of four adjacent input pixels (2×2). The RGB input signal (I11, I12, I21, I22) represents each pixel as RGB data. The method converts the set of 4 input RGB pixels into 8 subpixel drive values (2×RGBW), corresponding to subpixels on the display as shown in the figure.

The multi-primary conversion (MPC) then provides a representation of each pixel as RGBW data, denoted as (RI11, GI11, BI11, WI11, . . . , BI22, WI22).

A mapping function (MAP) then selects the RGB values for two of the pixels (pixels S11 and S22) and selects the W data for the other two pixels (pixels S12 and S21), and this data is used in the drive (DR) of the display. One example of the drive scheme is shown. This mapping retains the perceived resolution despite the reduction in pixel drive data.

As shown in FIG. 3, the display has pixels arranged in rows, with a row of four sub-pixels per pixel. Two physical display pixels are shown, with sub pixels (RP11,GP11,BP11,WP11) for the pixel (1,1) and sub pixels (RP21,GP21,BP21,WP21) for the pixel (2,1). The rows of sub pixels are staggered, and the white sub-pixels are also arranged to be spaced apart, as shown. Taking a physical display pixel as a rectangular block of 8 subpixels (2×RGBW), another way to characterise the arrangement is that each physical pixel has a layout in the form RGBW/BWRG. Each display pixel is then driven by 8 values, i.e. with two RGBW input pixels, as obtained by the MAP algorithm. FIG. 3 shows the sub pixel value for each of the eight sub-pixels.

The chrominance resolution of the display with the above conversion algorithm is half the luminance resolution of the display, because only the RGB pixels can display colour information, while the W pixels cannot. This limits the chrominance resolution of images to be displayed to half the (perceived) resolution of the display. Although this is generally not a problem for natural content, which does not contain such high chrominance frequencies, it is a problem for graphics.

When an image has pixel-wide details, e.g. small text or thin lines, in saturated colours, these details could potentially be lost in the sub-pixel sampling. In particular, when an input pixel is mapped onto the white sub-pixel by the sub-pixel sampling, it is not possible to display any colour in this pixel.

When the chrominance resolution of the input data is only half the resolution of the display at most (which will be the case for data in YUV 4:2:2 format and lower colour sub-sampling formats, such as YUV 4:2:0), typically used for natural content, this is no problem, as the neighboring pixels, which are mapped on a RGB sub-pixel triplet, will contribute to the correct average colour. However, for material with a higher chrominance resolution, such as graphics, the neighboring pixels will have a different colour and the detail can be lost or the colour may be wrong.

A possible solution for this problem is to apply filtering to the incoming images. Simply low-pass filtering the RGB signal reduces the resolution of both the luminance and chrominance components, resulting in a reduced sharpness and thus a lower perceived resolution.

An alternative solution can apply low-pass filtering to only the chrominance components of the incoming signal (U and V data in YUV colour space). This reduces the chrominance resolution of images without losing perceived resolution. The low pass filtering essentially involves averaging the values over a set of adjacent pixels. For images with a very low or very high brightness this leads to colour errors, as there is no room in the neighboring pixels for the additional chrominance information. For example, when one pixel is red and the neighboring pixel is white, it is not possible to divide the chrominance over the two pixels, as the white pixel is already at its maximum value.

According to the invention, there is provided a method of processing image data, comprising:

(i) receiving input signals for specifying the colours of the pixels of a display;

(ii) performing a low pass filtering (40) of the input signals, the low pass filtering function being dependent on the chrominance variation at each pixel; and (iii) providing the filtered output signals for use in driving the pixels of a display.

This method essentially measures the chrominance variation of the incoming signal, and depending on this variation, adaptively low-pass filters the incoming signal. This can be in such a way that the chrominance resolution of the outgoing signal is below the maximum chrominance resolution of the intended display, without errors in the average colour of a small group of pixels. Furthermore, the adaptive filtering algorithm can also be arranged not to low-pass filter incoming signals with a chrominance resolution already below the maximum chrominance resolution of the intended display.

The input signal can specify the colour in RGB space, but also in other colour spaces including (YUV) and others The chrominance variation is measured and adapted locally (per-pixel), so that only those parts of the image that have a too high chrominance resolution are filtered, while other parts of the same image keep their original sharpness.

In order to determine the colour change frequency, the method may further comprise obtaining a measurement representing the colour change frequency between adjacent pixels by performing a low pass filtering operation to the input signals; and subtracting the low pass filtered signal from the input signals to derive a high pass signal based on the high frequency components.

The U and V components of a YUV representation of the high pass signal can be used to obtain the measurement representing the colour change frequency.

The same low pass filtering can be used for obtaining the measurement representing the colour change frequency between adjacent pixels and for the low pass filtering dependent on the measurement representing the colour change frequency. In this way, the low pass filtering is carried out only once, and this low pass filtered signal is used both to provide the measurement of the colour change frequency and to change the pixel data when required.

The per-pixel low pass filtering can comprise multiplying the input signals by a first attenuation factor (1−k) and adding a low pass filtered version of the input signal multiplied by a second attenuation factor (k), the first and second attenuation factors adding to 1 and being dependent on colour change frequency. This provides a variable low pass filtering function, the variation being implemented as a variable fraction of the input signal which is replaced by a low pass filtered version.

The per-pixel low pass filtering may comprise applying a filtering process to adjacent pixels within the same row, for example averaging pixel RGB values with the pixel RGB values for the pixels on each side, with the pixel having a double weighting to the pixels on each side.

Alternatively, the per-pixel low pass filtering can comprise applying a filtering process to adjacent pixels within a block comprising rows and columns of pixels, for example averaging the pixel RGB values with the pixel RGB values for the pixels on each side and above and below, with the pixel having a quadruple weighting to the pixels on each side and above and below.

Alternatively, the filtering can comprise more adjacent rows and pixels, and other weighting factors, including high precision signed values.

The method preferably further comprises (multi-primary colour) processing the low pass filtered signals to derive RGBW pixel values for each pixel, and mapping from the RBGW pixel values to a set of subpixel drive values corresponding to subpixels on the display (for example comprising half the number of pixel values). This mapping may comprise, for each set of four adjacent input pixels in a square configuration, taking the RGB values for two of the pixels and the W values for the other two pixels to derive 8 sub pixel values.

The invention also provides a method of driving a display device, for example an LCD, comprising:

receiving input signals;

applying the processing method of the invention; and driving the display with sub-pixel values derived from the output signals.

The invention also provides an apparatus for driving a display including an array of display pixels, comprising processing means operable to:

receive input signals for specifying red, green and blue colours of the pixels of a display;

perform a per-pixel low pass filtering of the input signals, the low pass filtering function being dependent on the chrominance variation between adjacent pixels; and provide the filtered output signals for use in driving the pixels of a display.

The processing means is preferably further operable to process the filtered output signals to derive RGBW pixel values for driving a display with red, green, blue and white sub-pixels.

The processing means is preferably further operable to map from the RGBW pixel values to a set of pixel values comprising half the number of pixel values.

The invention also provides a display device comprising an array of display pixels and a display driver comprising a driving apparatus of the invention.

The invention also provides a computer program comprising computer code means adapted to perform all the steps of the method of the invention when said program is run on a computer.

Embodiments of the invention will now be described, by way of example only, with reference to the following diagrams wherein:

FIG. 4 shows the method/system of the invention, in which an additional pre-filtering step 40 has been added to the system/method of FIG. 2.

This pre-filtering step adaptively low-pass filters the incoming images so that filtering is performed if the local chrominance variation is high. This can reduce the chrominance resolution of the outgoing signal to below the maximum chrominance resolution of the intended (RGBW) display, without errors in the average colour of a small group of pixels. For image portions (or whole images) which do not have the high chrominance variation, no low-pass filtering needs to be employed.

Figure 5:
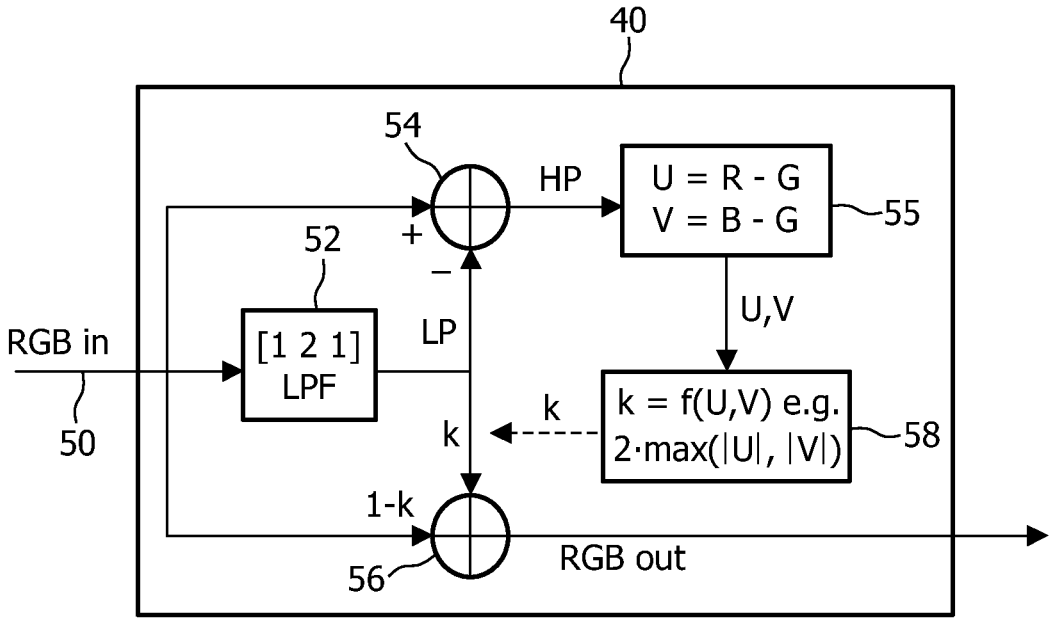
FIG. 5 shows in more detail one pre-filtering method for use in FIG. 4.

FIG. 5 shows an example of implementation of the filtering process.

The RGB data is received at the input 50, and is supplied to a low pass filter 52.

In the example shown, the low pass filter is a ¼·[1 2 1] filter. Thus, the filter performs averaging the pixel RGB values with the pixel RGB values for the pixels on each side, with the pixel having a double weighting to the pixels on each side. The filtering is carried out as an averaging in horizontal (row) direction only.

The resulting low-pass filtered RGB signal (LP) is subtracted from the RGB input signal at the adder 54, to create a high-pass filtered version of the RGB signal (HP).

The chrominance components (i.e. the U and V values in YUV format) of the high-pass filtered signal are approximated as U=R−G and V=B−G in block 55 and the maximum of their absolute values indicates the chrominance variation.

Thus, for each pixel, the filter 52 enables a chrominance variation to be obtained based on the pixel and the adjacent pixels (to each side in this example), and this chrominance variation determines how much filtering, if any, is needed.

The output signal RGB out is the weighted average of the low-pass filtered RGB signal LP and the input RGB signal, with the weighting determined by the chrominance variation (or another function of U and V).

This weighted average is output from the adder 56.

When the chrominance variation is high, the output signal contains more of the low-pass filtered input signal, and when the chrominance variation is low, the output signal contains more of the original input signal.

In the example of FIG. 5, the weighting value k is derived from the maximum absolute value of U and V, and is set at double this value, in the block 58. The multiplier (2 in this example) of course takes account of the magnitude of the U and V signals, and obtains a value of k which will roughly vary between 0 and 1.

Preferably, the weighting factor is chosen such that the RGB output signals have a maximum chrominance variation corresponding to the maximum chrominance resolution of the display, and which may be lower than the maximum luminance resolution, as explained above.

The pre-filtering method is applied to the incoming RGB signal, before RGB to RGBW conversion and sub-pixel sampling. In this way, the pre-filtering method can be used with other algorithms in a flexible way and can be added to the existing processing chain without changes to the algorithms.

The example above uses a simple filtering operation based on groups of three row-wise pixels.

Figure 3:
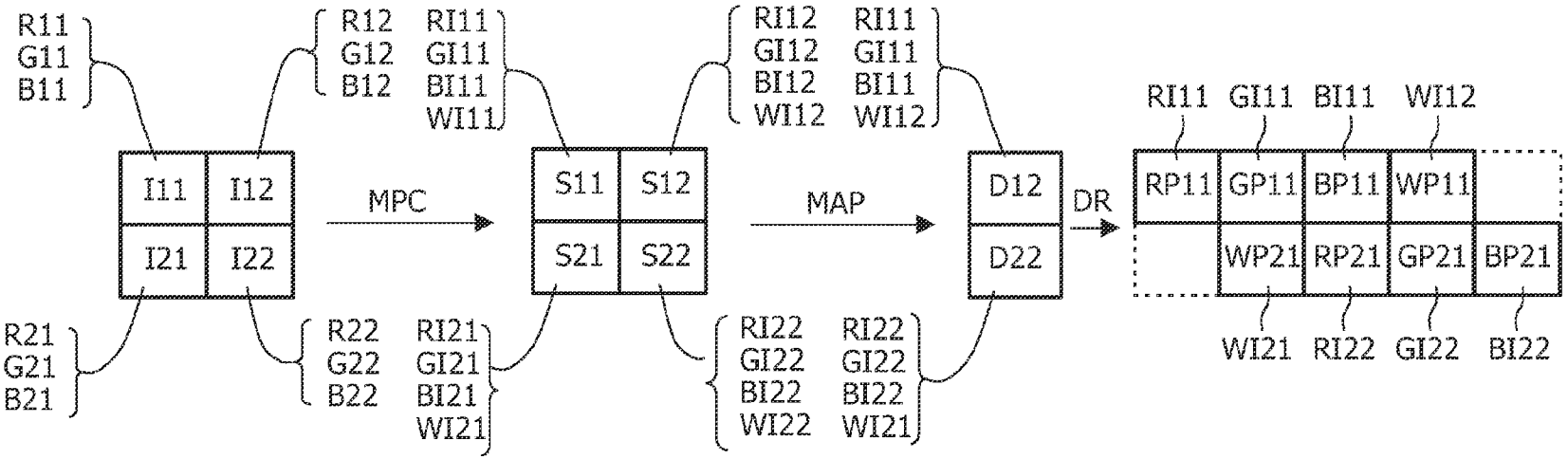
FIG. 3 shows in more detail the sub-pixel mapping used in FIG. 2.

The most problematic pattern for an RGBW panel with a pixel configuration as in FIG. 3 is a checkerboard with a high chrominance variation and a low or high luminance, for example a red with white checkerboard. Such patterns can be filtered more effectively with a two-dimensional filter, for example:

$$\frac{1}{8}\cdot\begin{bmatrix} 0 & 1 & 0 \\ 1 & 4 & 1 \\ 0 & 1 & 0 \end{bmatrix}$$

This filter averages the pixel RGB values with the pixel RGB values for the pixels on each side and above and below, with the pixel having a quadruple weighting to the pixels on each side and above and below.

Such two-dimensional filtering may give an improved response, although with higher implementation costs. In practice, the response obtained using a simple one dimensional filter is found to be appropriate.

Figure 1:
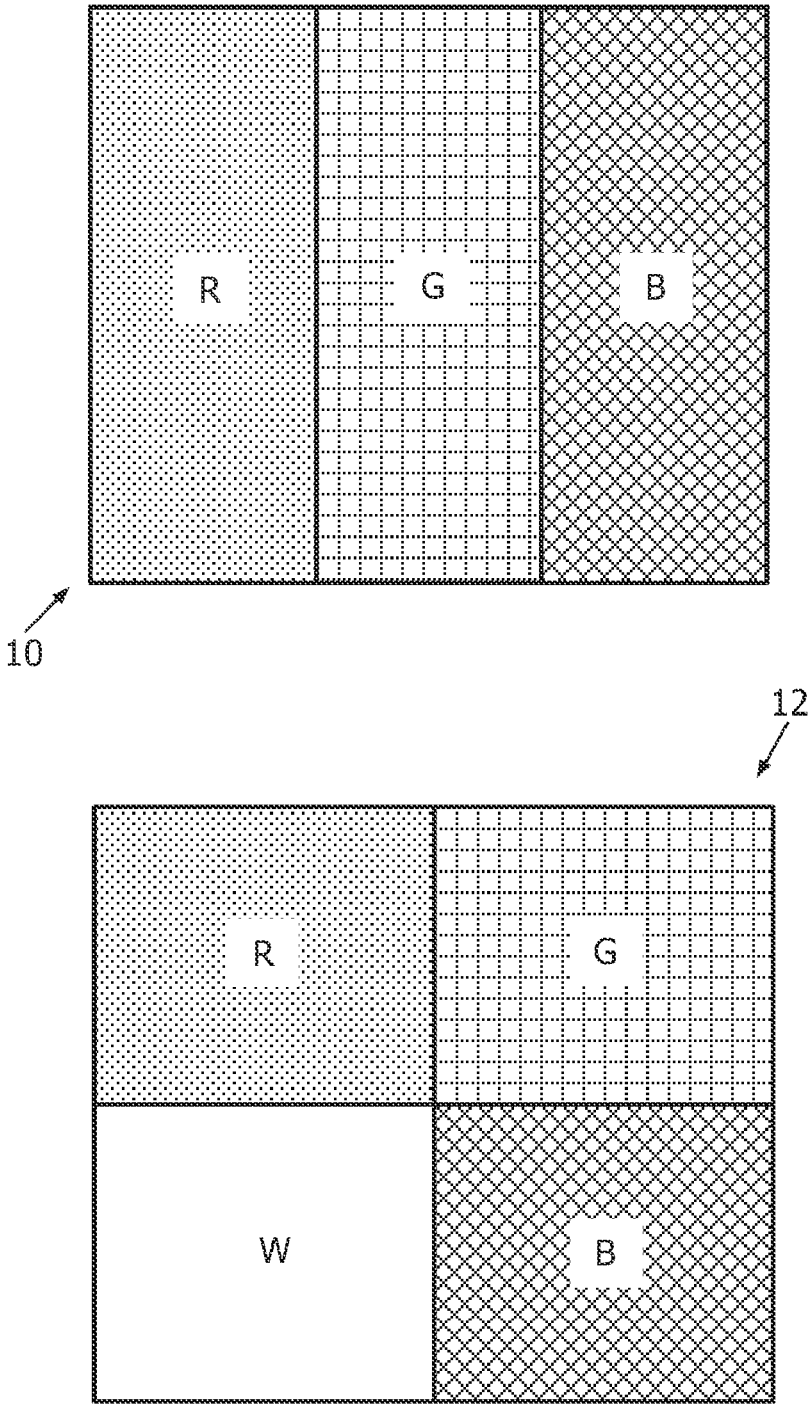
FIG. 1 (Prior Art)
FIG. 1 shows a known RGB pixel layout and RGBW pixel layout.
Figure 2:
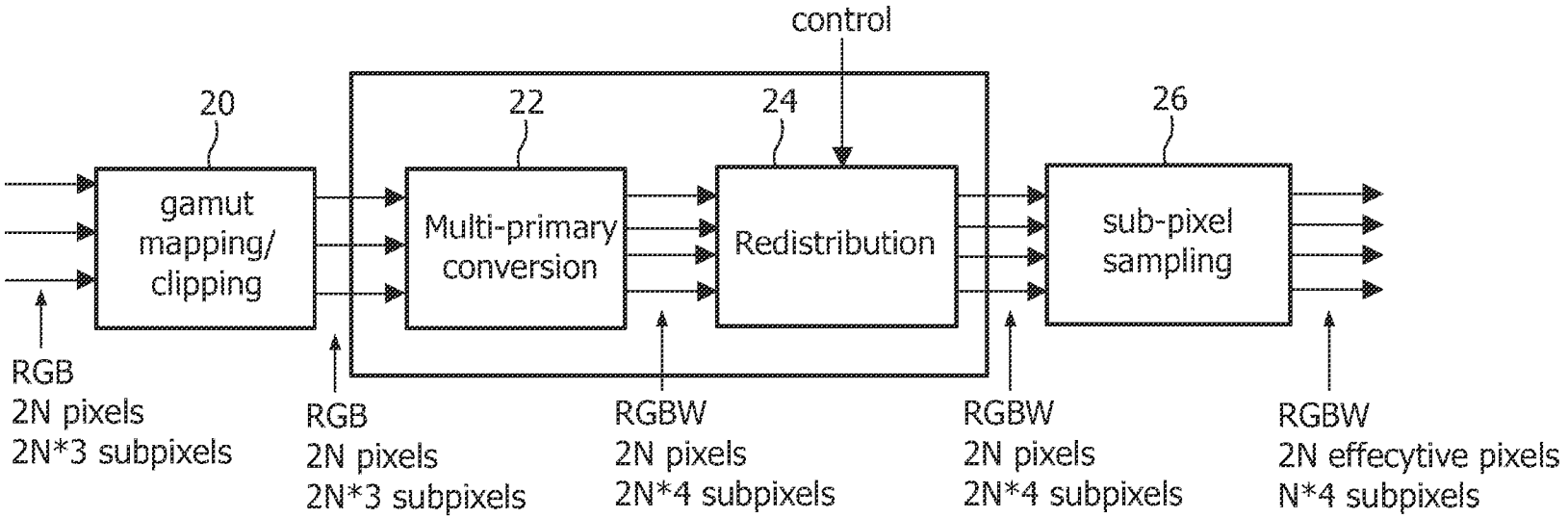
FIG. 2 shows a proposed pixel driving method/system for driving RGBW pixels with reduced sub pixel count.
Figure 4:
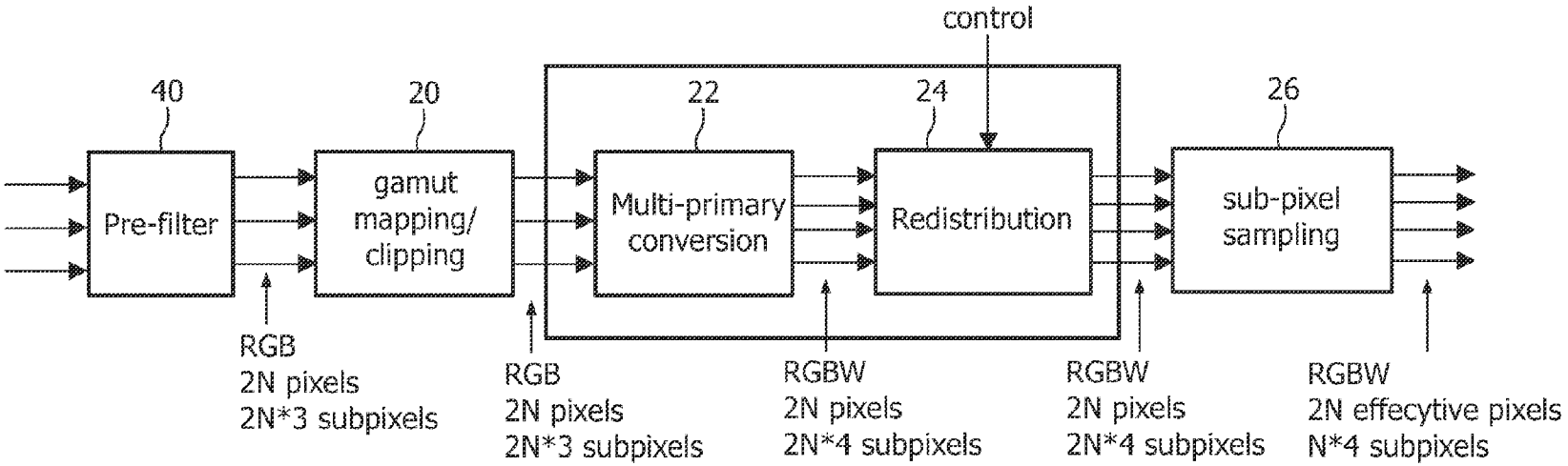
FIG. 4 shows the pixel driving method/system of the invention for driving RGBW pixels with reduced sub pixel count.

The pre-filtering method of the invention enables simple sub-pixel sampling to be employed (block 26 in FIGS. 2 and 4), and enables content without high chrominance resolutions to be displayed with no filtering, while content with high chrominance resolution is locally low-pass filtered to prevent colour errors.

Figure 6:
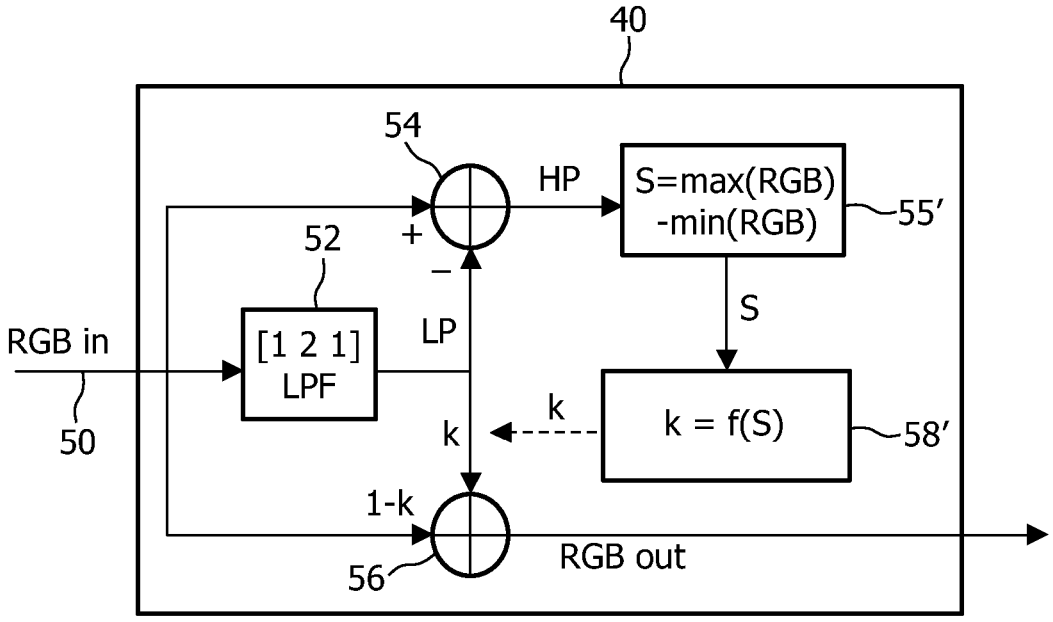
FIG. 6 shows an alternative pre-filtering method for use in FIG. 4.

In the example of FIG. 5, the U and V values are used to determine the chrominance values of the high pass signal. FIG. 6 shows an alternative arrangement in which RGB values are used.

In block 55', the saturation S is determined, which is the difference between the maximum and minimum RGB values. This essentially corresponds to the value max(|U|,|V|) which is also a saturation value. The function then becomes k=f(S) (for example K=2S) in block 58'. When the chrominance variation is high, this saturation variation is also high.

Figure 7:
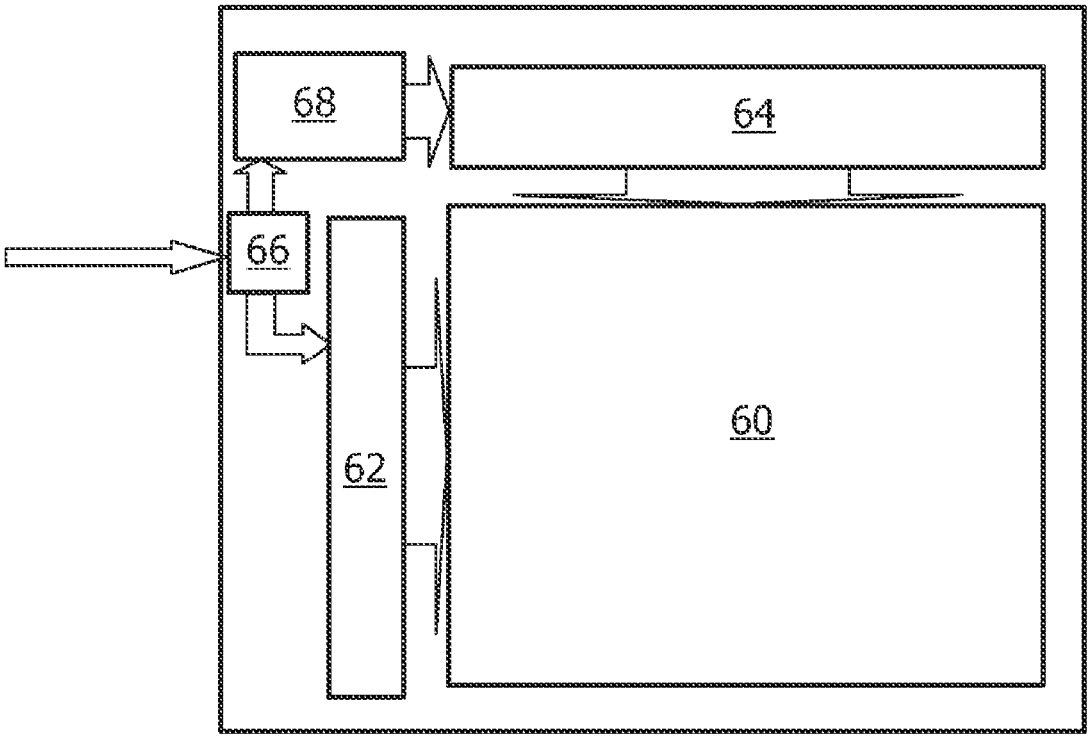
FIG. 7 shows a display device of the invention.

FIG. 7 shows a display device of the invention, comprising an array 60 of pixels, driven by a row driver 62 and a column driver 64. The input RGB input data signals are supplied to a display controller 66, and these are mapped into the required sub-pixel form by a mapping unit 68, which includes the pre-filter system of the invention. The mapping unit 68 comprises the system shown in FIG. 4 and includes a processor for implementing the signal processing functions.

The sub-pixel sampling problem is described for RGBW displays, but it does also exist with sub-pixel sampling for other displays. Some examples are RGBx, where x can be any additional sub-pixel, e.g. RGBY with an additional yellow sub-pixel. The same issue can also arise with conventional RGB displays with sub-pixel sampling. By performing the pre-filtering on the RGB input signal, it can be used for any display with a chrominance resolution that is lower than its luminance resolution.

One particular example of sub-pixel layout has been shown in which four pixels are represented by eight sub-pixels. There are other implementations in which a smaller number of sub-pixels are used than the standard number (3N for N pixels). Various sub-pixilation techniques can be used to obtain an increase in effective resolution, and these may or may not involve the use of white sub-pixels.

The pre-filtering described above can be implemented in software, and the functional blocks in FIGS. 5 and 6 should not therefore be considered to be physical hardware components.

The present invention is not limited to liquid crystal display (LCDs) but is also applicable to driving micro-mirror arrays employed for projecting images; such arrays are referred to as digital micromirror devices (DMDs).

The invention is also applicable to displays fabricated from arrays of elements wherein each element is individually addressable and comprises light emitting diodes of red, blue, green and white colours. In another related example, the invention is applicable to displays fabricated from arrays of elements implemented with vertical-cavity surface-emitting lasers (VCSELs) which are optionally individually addressable.

Moreover, the present invention is also capable of being implemented in conjunction with organic LED (OLED) displays.

The method of the invention can be applied to colour data which specifies the pixel colour in any format. Colour processing can be applied initially to convert the colour data into a desired format (for example RGB) for further processing.

The chrominance variation may be considered as a frequency with which colours change.

The invention is of particular benefit for displays with lower chrominance resolution, and this is the case generally for RGBW displays, and particularly for displays in which the display is driven with a sub-sampled set of sub-pixel values.

It should be noted that the above-mentioned embodiments are presented purely by way of example and that numerous modifications and alterations may be realised by those skilled in the art while retaining the teachings of the invention.

The invention claimed is:

1. A method of processing image data, comprising:

(i) receiving input signals for specifying the colours of the pixels of a display;

(ii) performing a low pass filtering of the input signals, the low pass filtering function being dependent on the chrominance variation at each pixel; and (iii) outputting the filtered output signals for use in driving the pixels of a display, and displaying the filtered output signals on the display, wherein the per-pixel low pass filtering comprises applying a filtering process to adjacent pixels within a block comprising rows and columns of pixels, and multiplying the input signals by a first attenuation factor and adding a low pass filtered version of the input signal multiplied by a second attenuation factor, the first and second attenuation factors adding to 1 and being dependent on the chrominance variation.

2. A method as claimed in claim 1, comprising obtaining a measurement representing the chrominance variation between adjacent pixels by:

performing a low pass filtering operation to the input signals; and subtracting the low pass filtered signal from the input signals to derive a high pass signal (HP) based on the high frequency components.

3. A method as claimed in claim 2, wherein the U and V components of a YUV representation of the high pass signal are used to obtain the measurement representing the chrominance variation.

4. A method as claimed in claim 2, wherein a value of a maximum of the RGB values less a minimum of the RGB values of the high pass signal is used as the measurement representing the chrominance variation.

5. A method as claimed in claim 2, wherein the same low pass filtering is used for obtaining the measurement representing the chrominance variation between adjacent pixels and for the low pass filtering dependent on the measurement representing the chrominance variation.

6. A method as claimed in claim 1, wherein the per-pixel low pass filtering comprises applying a filtering process to adjacent pixels within the same row.

7. A method as claimed in claim 6, wherein the per-pixel low pass filtering comprises, for each pixel, averaging a pixel RGB values with the pixel RGB values for the pixels on each side, with the pixel having a double weighting to the pixels on each side.

8. A method as claimed in claim 1, wherein the per-pixel low pass filtering comprises for each pixel, averaging a pixel RGB values with the pixel RGB values for the pixels on each side and above and below, with the pixel having a quadruple weighting to the pixels on each side and above and below.

9. A method as claimed in claim 1, further comprising:

processing the low pass filtered signals to derive RGBW pixel values for each pixel of the display.

10. A method as claimed in claim 9, further comprising mapping from RGBW output signals to RGBW sub pixel values for use in driving a display.

11. A method as claimed in claim 9, wherein the method further comprises performing mapping from the RGBW pixel values to a smaller set of pixel values.

12. A method as claimed in claim 11, wherein the mapping comprises, for each set of four adjacent pixels in a square configuration, taking the RGB values for two of the pixels and the W values for the other two pixels to derive 8 sub pixel values.

13. A method of driving a display device, comprising:

receiving input signals;

applying the method as claimed in claim 1; and driving the display with sub-pixel values derived from the output signals.

14. A method as claimed in claim 13, wherein driving the display comprises driving the display with a sub-sampled set of sub-pixel values.

15. A method as claimed in claim 13 for driving a liquid crystal display.

16. A method as claimed in claim 13, comprising driving a display device with a lower chrominance resolution than luminance resolution.

17. An apparatus for driving a display including an array of display pixels, comprising processing means operable to:

receive input signals for specifying red, green and blue colours of the pixels of a display;

perform a per-pixel low pass filtering of the input signals, the low pass filtering function being dependent on the chrominance variation between adjacent pixels;

provide the filtered output signals for use in driving the pixels of a display;

process the filtered output signals to derive RGBW pixel values for driving a display with red, green, blue and white sub-pixels; and map from the RBGW pixel values to a set of pixel values comprising half the number of pixel values;

wherein the processing means is further operable, for each set of four adjacent pixels in a square configuration, to utilize the RGB values for two of the pixels and the W values for the other two pixels to derive 8 sub-pixel values.

18. A display device comprising an array of display pixels and a display driver comprising an apparatus as claimed in claim 17.

* * * * *